US005770982A

United States Patent [19]

Moore

[11] Patent Number: 5,770,982

[45] Date of Patent: Jun. 23, 1998

[54] SELF ISOLATING HIGH FREQUENCY SATURABLE REACTOR

[75] Inventor: James A. Moore, Powell, Tenn.

[73] Assignee: Sematech, Inc., Austin, Tex.

[21] Appl. No.: 739,340

[22] Filed: Oct. 29, 1996

[51] Int. Cl.[6] ..... K03H 7/38; H01F 21/00

[52] U.S. Cl. ..... 333/32; 334/12; 323/308; 323/310; 323/362; 336/155; 336/181; 336/212; 336/229

[58] Field of Search ..... 333/17.3, 24 R, 333/32, 33, 226; 336/155, 181, 212, 223, 229; 334/12, 71, 76; 323/307, 308, 310, 356, 362

[56] References Cited

U.S. PATENT DOCUMENTS

| | | | |
|---|---|---|---|
| 1,287,982 | 12/1918 | Hartley | 336/155 X |
| 1,849,845 | 3/1932 | Mayo | 336/181 X |
| 2,915,723 | 12/1959 | Wennerberg | 336/155 |
| 4,311,972 | 1/1982 | Landt et al. | 333/17.3 |
| 4,430,615 | 2/1984 | Calvert | 336/212 X |
| 4,951,009 | 8/1990 | Collins | 333/17.3 |
| 5,065,118 | 11/1991 | Collins et al. | 333/33 |
| 5,170,098 | 12/1992 | Dutton et al. | 315/111.21 |
| 5,187,454 | 2/1993 | Collins et al. | 333/17.3 |
| 5,210,466 | 5/1993 | Collins et al. | 315/111.21 |
| 5,273,610 | 12/1993 | Thomas, III et al. | 156/345 |
| 5,325,019 | 6/1994 | Miller et al. | 315/111.21 |
| 5,392,018 | 2/1995 | Collins et al. | 336/155 |
| 5,407,524 | 4/1995 | Patrick et al. | 156/627 |
| 5,424,691 | 6/1995 | Sadinsky | 333/17.3 |
| 5,440,278 | 8/1995 | Bartholomew | 332/103 |
| 5,450,052 | 9/1995 | Goldberg et al. | 336/83 |
| 5,473,291 | 12/1995 | Brounley | 333/17.3 |

OTHER PUBLICATIONS

*Radio Communication Handbook*, Sixth Edition, Radio Society of Great Britain, Editor: Dick Biddulph, 1994 G8DPS, ISBN 1–872309–24–0, pp. 6.30–6.33, no month.

*Primary Examiner*—Paul Gensler
*Attorney, Agent, or Firm*—Kidd & Booth

[57] ABSTRACT

The present invention discloses a saturable reactor and a method for decoupling the interwinding capacitance from the frequency limitations of the reactor so that the equivalent electrical circuit of the saturable reactor comprises a variable inductor. The saturable reactor comprises a plurality of physically symmetrical magnetic cores with closed loop magnetic paths and a novel method of wiring a control winding and a RF winding. The present invention additionally discloses a matching network and method for matching the impedances of a RF generator to a load. The matching network comprises a matching transformer and a saturable reactor.

21 Claims, 13 Drawing Sheets

SELF ISOLATING HIGH FREQUENCY SATURABLE REACTOR

The United States Government has rights in this invention pursuant to Cooperative Research and Development Agreement ("CRADA") No. 01082, among SEMATECH Inc., Sandia Corporation and Lockheed Martin Energy Research Corporation.

BACKGROUND OF THE INVENTION

1. Field of the Invention

This invention relates generally to impedance matching networks for matching a source impedance with a load impedance. More specifically, this invention relates to impedance matching networks for matching a RF generator with a plasma chamber for use in manufacturing semiconductor devices.

2. Description of the Related Art

A common goal in connecting a source of electrical power to an electrical load is to maximize the power transfer from the source to the load. This goal is met when the output impedance of the source, or generator, is equal to the complex conjugate of the input impedance of the load. In alternating current (ac) circuits, impedance has a resistive component, the real component, and an inductive or capacitive component, the imaginary component. In conventional complex number notation, an impedance Z is given by $Z=R+jX$, where R is the real component, X is the imaginary component, and j is an operator equal to the square root of −1. Impedances are said to be complex conjugates when their resistive components are equal and their imaginary components are equal in magnitude but opposite in sign. If a generator impedance is $Z_G=R_G+jX_G$, then maximum power will be transferred to a load when the load impedance is $Z_L=R_G-jX_G$. Another way of thinking of complex conjugates is in terms of vector quantities. A simple resistive impedance may be thought of as a vector with a phase angle of zero. A complex impedance has a magnitude and a phase angle. Impedances that are complex conjugates of each other have equal magnitudes, but phase angles of equal magnitude and opposite sign.

In many circuit applications, the source or generator impedance does not match the load impedance, and it is necessary to use an impedance matching network between the source and the load to transfer maximum power. Basically, the function of the impedance matching network is to present to the generator an impedance equal to the complex conjugate of the generator impedance, and to present to the load an impedance equal to the complex conjugate of the load impedance. The matching network typically contains a number of interconnected inductors and capacitors, some of which are adjustable in value to achieve the desired result.

U.S. Pat. No. 4,951,009 discloses an impedance matching circuit where the variable impedance element is an inductor comprising a primary winding on a toroidal core of magnetic material. U.S. Pat. No. 5,392,018 discloses an impedance matching circuit where the variable impedance element is an inductor comprising a primary winding on a tubular core of magnetic material. And, U.S. Pat. No. 5,424,691 discloses an impedance matching circuit where the variable impedance element is an inductor comprising a primary winding on an "E" shaped core of magnetic material. These prior art matching networks are for impedance matching networks for matching a RF generator with a plasma chamber for use in manufacturing semiconductor devices. Each of these designs use a variation on a saturable reactor for their variable inductor in the matching network. The impedances of these inductors are adjustable by a low frequency or DC current in a secondary winding on the magnetic core. The DC current generates a magnetic field that partially saturates the magnetic material that alters the inductance seen at the primary winding. While these designs allow solid state manufacture, they have the disadvantage that transformer coupling between the primary and secondary windings reflects parasitic or interwinding capacitances between the secondary winding(s) and the primary winding. The interwinding capacitances occur as a result of the winding of the coils comprising the inductors within the matching network, and occurs between any two adjacent windings (or layers) of the coil. The parasitic capacitances alter the impedance of the primary winding away from the desired impedance and generate undesirable high-frequency resonances into both the primary and secondary windings. One common technique to overcome the effects of the parasitic capacitances as seen in the above patents is to increase the current flowing into the primary winding of impedance matching network from the source generator and also increase the control current flowing into the secondary winding.

These prior art matching networks suffer from several drawbacks resulting from unwanted resonances due to interwinding capacitances. First, all of the designs are subject to unwanted resonances in both the primary winding and the secondary winding resulting from interwinding or parasitic capacitances. Second, these designs require large magnetic cores that are able to carry the high RF currents through the primary winding and high control currents through the secondary windings. Third, these designs typically operate at very high temperatures due to the high currents used in the system. And finally, these designs typically require some type of RF filtering in the control circuit of the secondary winding to prevent the RF resonances from leaking into the DC source.

It will be appreciated from the foregoing that there is still a need for improvement in the field of dynamically adjustable impedance matching networks. The need is particularly acute in the field of plasma processing, as used in the fabrication of semiconductor circuitry. When the electrical load is a plasma, the load impedance is dynamic and nonlinear, and changes as more power is coupled to it, and as other variables, such as gas pressure and composition, are changed. Therefore, although the load impedance may be measured or estimated, for purposes of adjusting a matching network to optimize power transfer, the load impedance will change whenever the network values are adjusted. Accordingly, a dynamically adjustable network is essential for efficiently coupling power to a plasma chamber. The present invention provides an electronically variable inductor whose RF impedance is independent of the control winding circuit over all frequencies for which the cores remain matched in their magnetic properties and overcomes the previously described limitations.

SUMMARY OF THE INVENTION

The present invention discloses an electronically tunable saturable reactor and a method for decoupling the interwinding capacitance from the frequency limitations of the reactor so that the equivalent electrical circuit of the saturable reactor comprises a variable inductor. The saturable reactor comprises a plurality of physically symmetrical magnetic cores with closed loop magnetic paths and a method of wiring a control winding and a RF winding that decouples the interwinding capacitance from the equivalent electrical circuit. The magnetic cores further comprise toroidal cores with matching magnetic permeability and saturation flux density characteristics. The method of wiring the RF winding comprises a figure "8" around the cores. The wiring of the RF winding causes a turn to turn bootstrapping of the interwinding capacitance of the control winding, which produces the desired decoupling effect.

The present invention additionally discloses an electronically tunable matching network and method for matching the impedances of a RF generator to a load. The matching network comprises a matching transformer and a saturable reactor. The saturable reactor comprises the previously described saturable reactor and method for decoupling the interwinding capacitance from the frequency limitations of the reactor. The equivalent electrical circuit of the matching network of the present invention is a transformer and a variable inductor.

DETAILED DESCRIPTION OF THE INVENTION

This disclosure describes an apparatus and method for a variable inductor. Additionally, this disclosure describes numerous specific details that include specific circuits, reactors, and processes in order to provide a thorough understanding of the present invention. One skilled in the art, however, will appreciate that one may practice the present invention without these specific details. In other instances, this disclosure does not describe well known processes and structures in detail in order not to obscure the present invention. Although this disclosure describes an apparatus and method for a matching network matching a RF source to a plasma load for semiconductor manufacturing, one skilled in the art will appreciate that the techniques described in this disclosure will apply to other situations requiring a matching network, i.e., coupling a RF antenna to a RF generator or any application requiring an electronically variable inductor.

Figure 1:
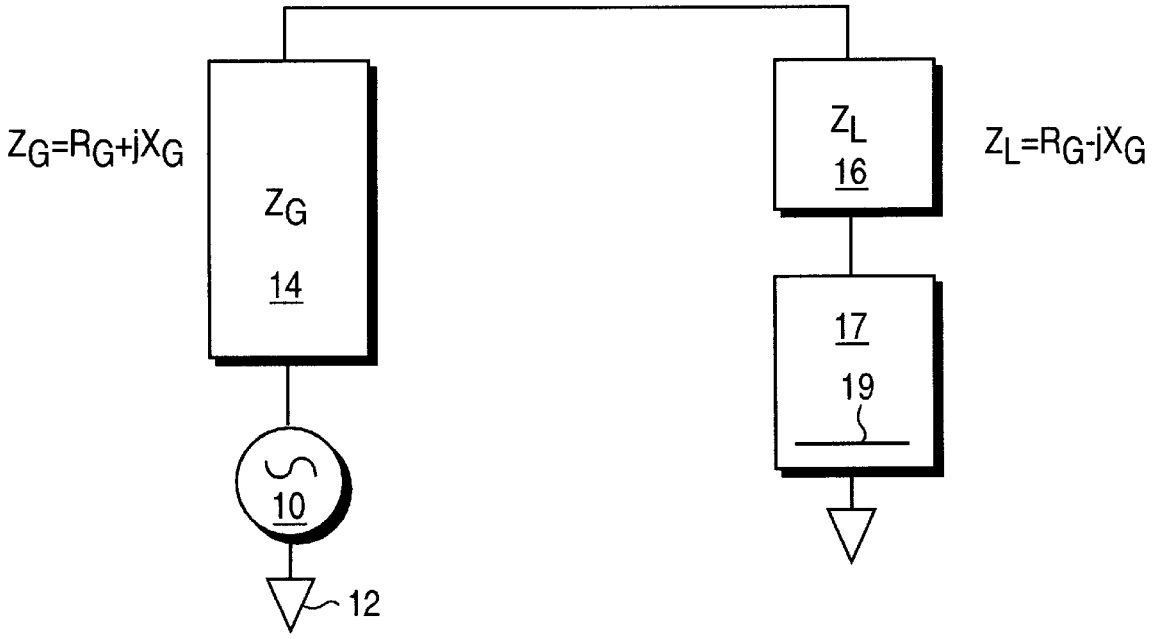
FIG. 1 shows a power generator and a load.

FIG. 1 discloses a RF generator 10 with an output impedance 14. Generator 10 drives a load 17 with an input impedance 16 where load 17 is a plasma chamber containing a semiconductor device 19 for processing. Both generator 10 and load 17 connect to a ground 12. As previously discussed, maximum power transfer will occur when the input impedance 16 of load 17 is the complex conjugate of the output impedance 14 of RF generator 10. That is, a generator impedance 14 of $Z_G=R_G+jX_G$ needs a load impedance 16 of $Z_G=R_G-jX_G$ for maximum power transfer.

Figure 2:
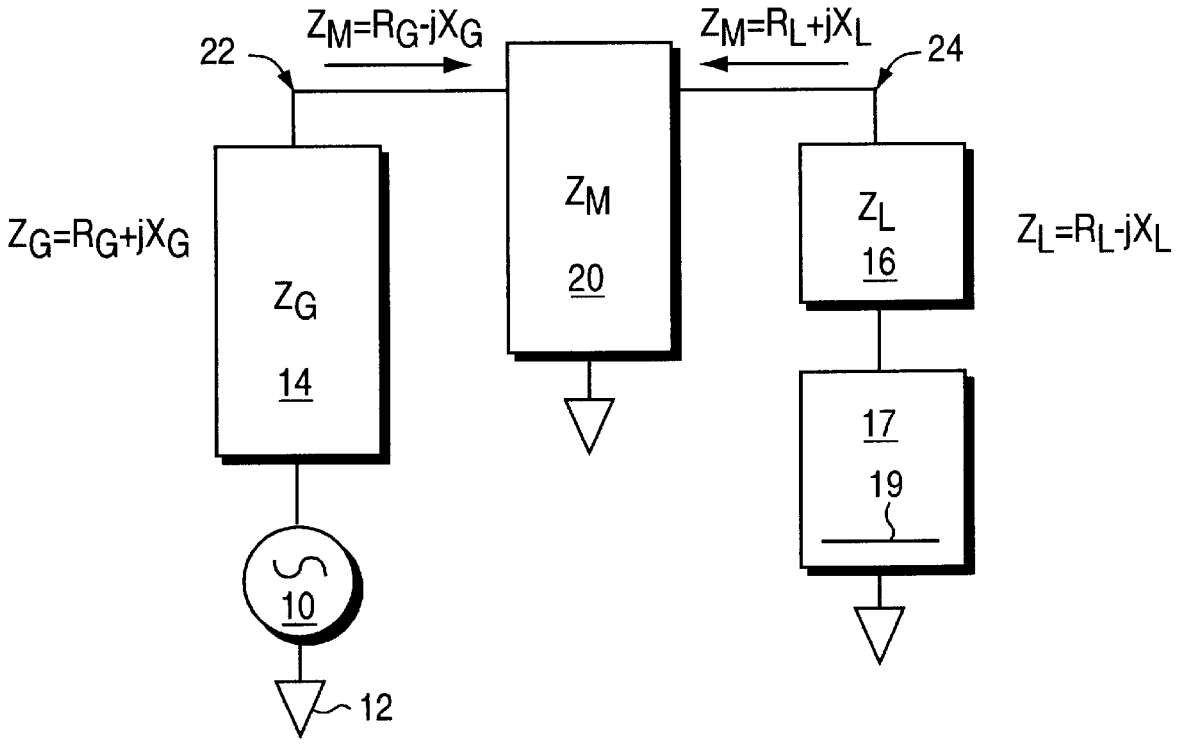
FIG. 2 shows a matching network between the generator and the load of FIG. 1 to maximize the power transfer.

Since the input impedance 16 of load 17 changes dynamically as a result of the plasma, a matching network 20 in FIG. 2 is necessary to match the impedances of RF generator 10 and load 17. The matching network 20 presents the complex conjugate of the generator impedance 14 at node 22 to generator 10, which is $Z_M=R_G-jX_G$. While at the same time, the matching network 20 presents the complex conjugate of the load impedance 16 at node 24 to load 17, which is $Z_M=R_L+jX_L$.

Figure 3:
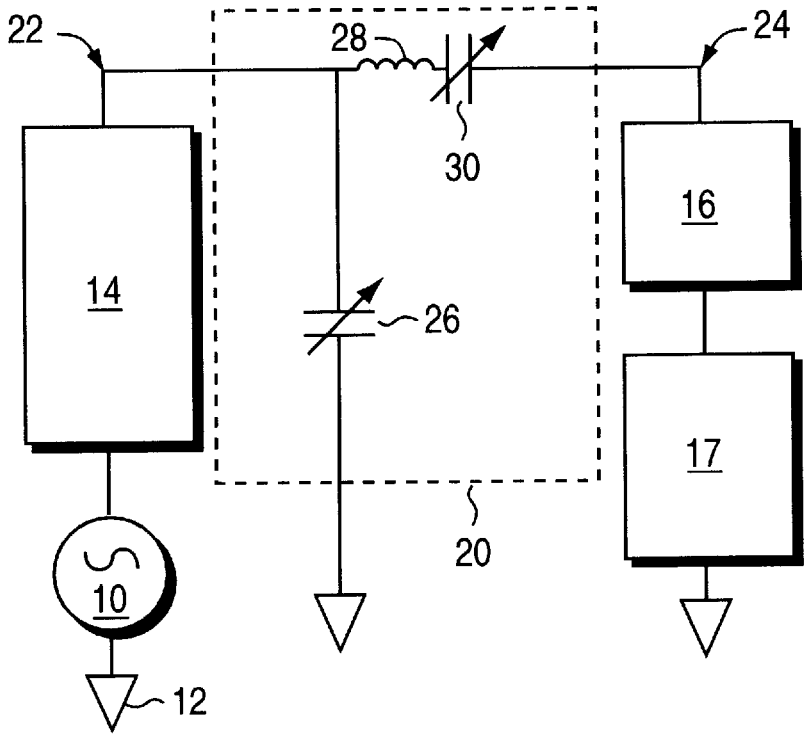
FIG. 3 (Prior Art)
FIG. 3 shows an example of a prior art matching network.
Figure 4:
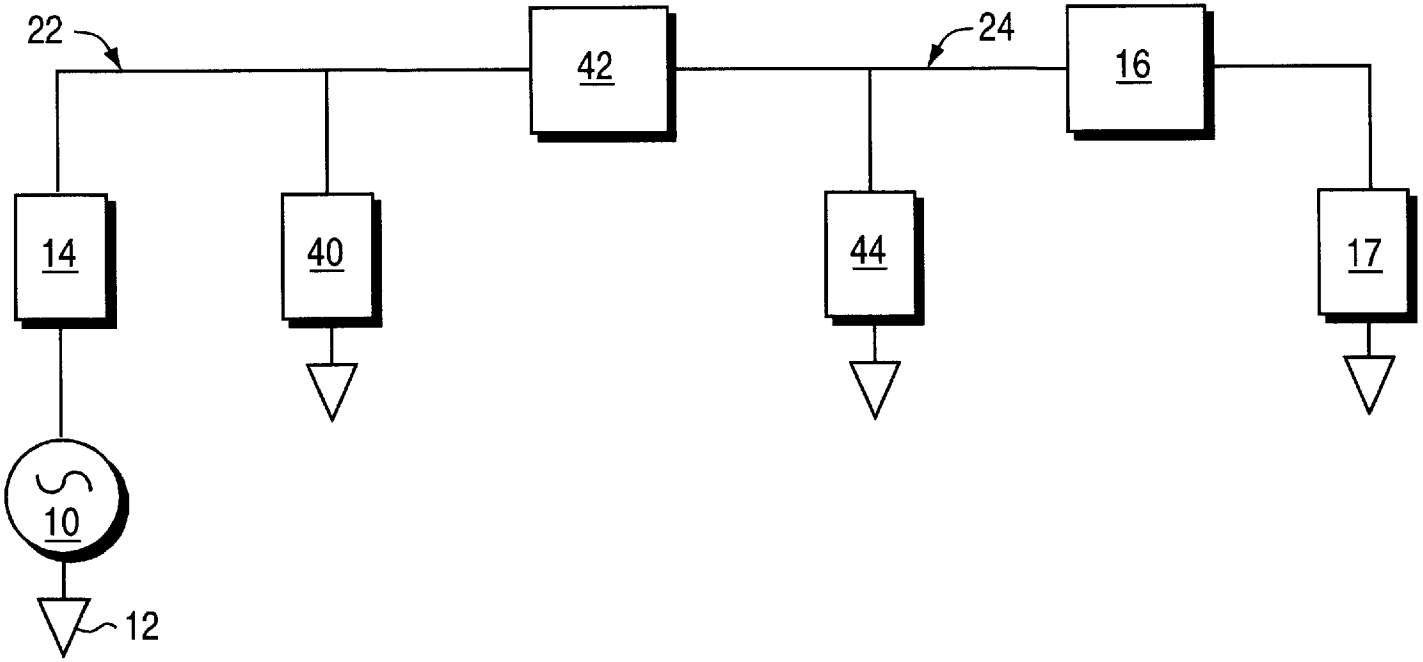
FIG. 4 (Prior Art)
FIG. 4 shows another example of a prior art matching network.

FIG. 3 illustrates one prior art version of the matching network 20 that consists of a variable capacitor 26, a variable capacitor 30, and an inductor 28 connected as shown. FIG. 4 illustrates a variation on the prior art network of FIG. 3 that uses complex matching networks 40, 42, and optionally matching network 44 in place of the discrete components in FIG. 3. However, the functionality of the matching networks are still the same. These prior art networks suffer from the disadvantages previously described in the Background section.

Figure 5:
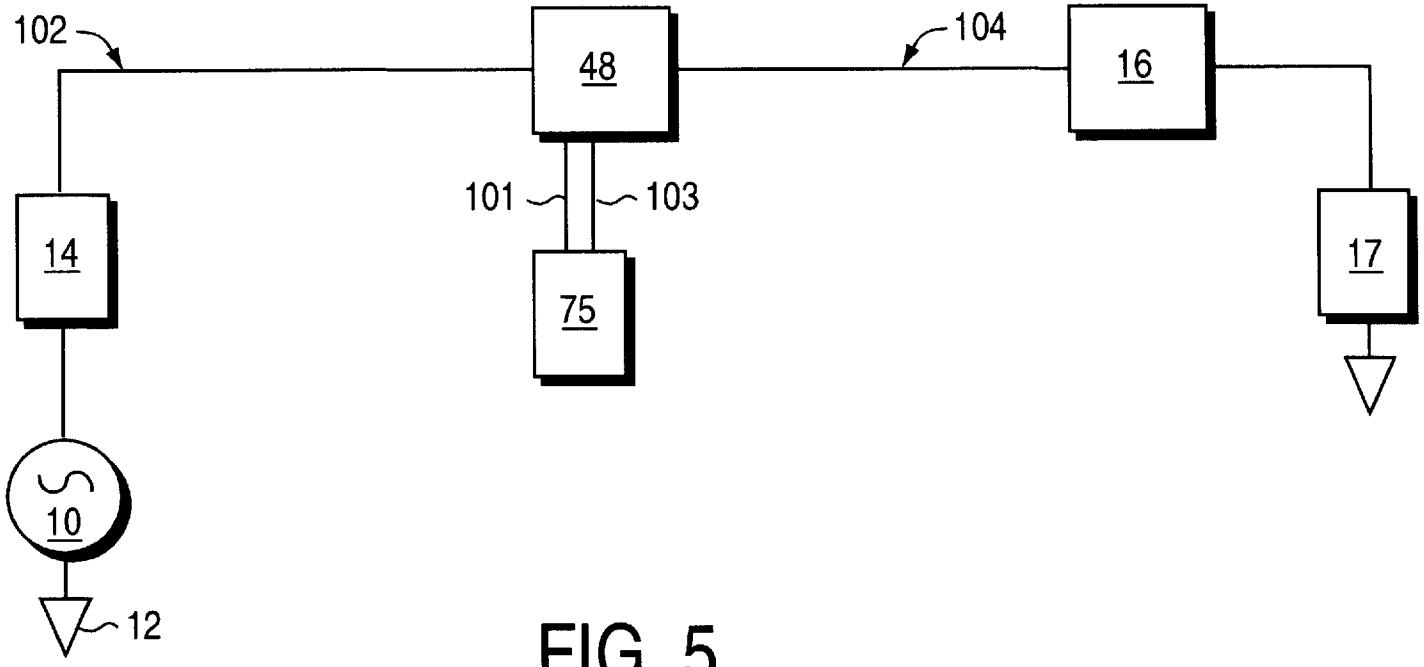
FIG. 5 is a block diagram of an embodiment of the present invention for matching the impedances of a generator and a load.

FIG. 5 is a block diagram of an embodiment of the present invention for matching the impedances of a generator 10 to a load 17. This embodiment of the present invention comprises generator 10 with an output impedance 14 where generator 10 couples to ground 12, and load 17 with an input impedance 16 where load 17 couples to ground 12. A matching network 48 matches the output impedance 14 of generator 10 to the input impedance 16 of load 17. A circuit node 102 represents the output impedance 14 of generator 10 as seen by matching network 48, which is $Z_G=R_G+jX_G$. A circuit node 104 represents the input impedance 16 of load 17 as seen by matching network 48, which is $Z_L=R_G-jX_G$. A control circuit 75 comprises a low frequency source, or DC current source, or a DC voltage source for controlling a magnetic core within matching network 48. Control circuit 75 couples to matching network 48 through a terminal 101 and a terminal 103.

A goal of the present invention was to build an electronic matching network for RF generators that uses a variable reactance controlled by an external bias current or voltage. I achieved this goal by modifying a saturable reactor for use as an electronic tuning element. Since the invention of high-power silicon controlled rectifiers (SCRs), saturable reactors are no longer used in AC power regulation; however, in past times saturable reactors were the most prominent means of AC power regulation. Saturable reactors also have seen use in magnetic amplifier circuits since somewhere around the turn of the 20th century. Magnetic amplifier circuits using saturable reactors are typically low-frequency devices because of the effects of parasitic winding capacitances of the coils and power transmission losses due to the magnetic cores. Nickel zinc ferrite magnetic materials made RF saturable reactors possible by providing an acceptable combination of permeability, saturation flux density, Curie temperature, core loss, and soft knee hysteresis loops. These materials do not, however, help the problem of turn-to-turn parasitic capacitance that would allow saturable reactors to operate efficiently in high frequency circuits.

Figure 6:
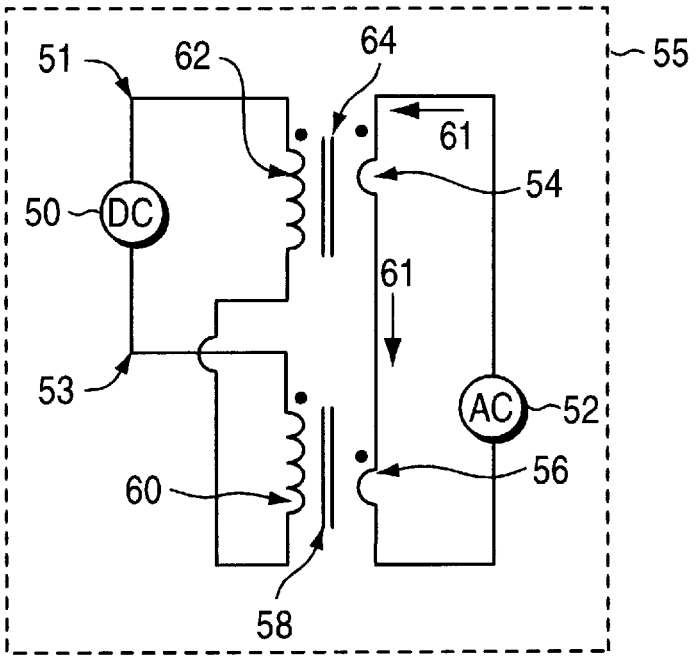
FIG. 6 is a schematic diagram of a prior art saturable reactor.

FIG. 6 illustrates a classical implementation of a saturable reactor 55 formed from two magnetic cores 58 and 64 wired so that the control windings are bucking (or opposing) the magnetic flux while the AC windings are aiding the magnetic flux. The AC signal path of saturable reactor 55 comprises an AC generator 52, an AC coil 54, and an AC coil 56. Combining AC coil 54 and AC coil 56 produces the AC winding of reactor 55. The DC or control circuit of reactor 55 comprises a DC source 50 with a DC terminal 51 and a DC terminal 53 with a coil 62 and a coil 60. Combining coil 60 and coil 62 produces the DC or control winding of reactor 55. In transformer terminology, a control winding is a secondary winding, and an AC or RF winding is a primary winding.

Saturable reactors work because the permeability of a magnetic material varies with the magnetic flux density in the magnetic core along a path called the hysteresis loop. Since permeability ($\mu$) is a linear term in the inductance of a coil (where $L=K\mu n^2$), if one can vary the permeability of the core by controlling its operating point on the hysteresis loop, then one can also vary its inductance by the same method. One must also ensure that the product of the RF current and the number of turns on the RF winding is small compared to the product of the minimum DC current and the number of turns on the DC or control winding. This will ensure that the movement of the operating point on the non-linear hysteresis loop as a result of the presence of the RF current is small and, thus, does not result in significant harmonic generation. An additional requirement is that the cross-sectional area of the magnetic core must be sized so that the magnetic flux density and core loss are kept within acceptable limits.

In FIG. 6, the voltage induced across coil 62 due to the AC signal 61 flowing through coil 54 is subtracted from the voltage induced across coil 60 due to the same AC signal 61 flowing through coil 56. If we use matched magnetic cores as in the present invention, the AC voltage appearing across the DC supply terminals 51 and 53 is zero and no AC current flows through coils 60 or 62. The AC and DC windings are therefore decoupled from each other and neither is affected by the other. In other words, the total magnetic flux for a saturable reactor is the sum of the AC and DC flux in each core algebraically summed, which is equal to 0. However, the flux is not 0 within the individual cores. This means that the flux density per core is dominated by the DC winding, which in turn allows the permeability of the magnetic cores to be controlled. The previous discussion describes the low-frequency operation of saturable reactors, but does not take into account the capacitive displacement current (parasitic capacitance) that flows between the DC windings and different layers of the coils in the DC (control) winding, which in turn generate power losses and reflect parasitic impedances into the AC windings.

The distributed capacitance of coils 60 and 62 in the control winding results in circulating AC currents. The circulating AC currents will resonate with the winding inductance and may produce destructive voltages at some frequencies. The distributed capacitance also results in resistive losses in the copper coils from the associated circulating currents of the distributed RLC network that the control winding actually comprises. These losses and their associated impedances are reflected through transformer action back into the AC winding so that instead of an inductance in series with a small frequency dependent resistor, the AC winding becomes a complex network of inductive and capacitive components and parasitic resonances. These effects can be detected in some saturable reactors and magnetic amplifier designs at frequencies as low as 440 Hz. There have been winding techniques devised to minimize this parasitic interwinding capacitance (such as winding layers back and forth along a toroid segment rather than around the toroid), but the frequency response improvement is only a factor of two or three and comes no where near extending the range to RF frequencies.

It is possible to extend the frequency response of saturable reactors into the low frequency RF region by severely reducing the number of turns in the control winding and raising the amplitude of the control current so that the product of the control current and the number of turns remains equal. However, this approach soon results in prohibitive control current and still has a fundamental frequency limitation with the additional byproduct of requiring much larger wires to handle increased control current as seen in the prior art such as the U.S. patents previously mentioned in the Background section of this disclosure. It rapidly becomes clear that the winding capacitance problem must be solved in a fundamental way if a satisfactory saturable reactor is to be designed for RF use such as at 13.56 MHz and above, where 13.56 MHz is typically found in RF generators in the semiconductor industry.

Since the mere presence of a control winding inescapably implies interwinding capacitance, it becomes clear that the effect of the capacitance must be nullified since the capacitance itself is inescapable. The approach taken to increase the frequency response of saturable reactors is a novel use of the technique of bootstrapping, used for many years to extend the high frequency response of electronic amplifier circuits. Bootstrapping is simply making the same voltage appear on both terminals of a capacitor. As a result of the same voltage appearing on both terminals of the capacitor, there is no voltage potential (or difference) across the capacitor. With no voltage across the capacitor, there is no current through the capacitor and the capacitor becomes undetectable electrically and no longer affects the circuit operation. The degree that the turn to turn bootstrapping (the coils of the winding) can be done successfully is the degree that the capacitor becomes electrically negligible. This means that to (turn to turn) bootstrap the interwinding capacitance of an RF saturable reactor, the RF voltage between adjacent points on the control winding must be the same.

Figure 7:
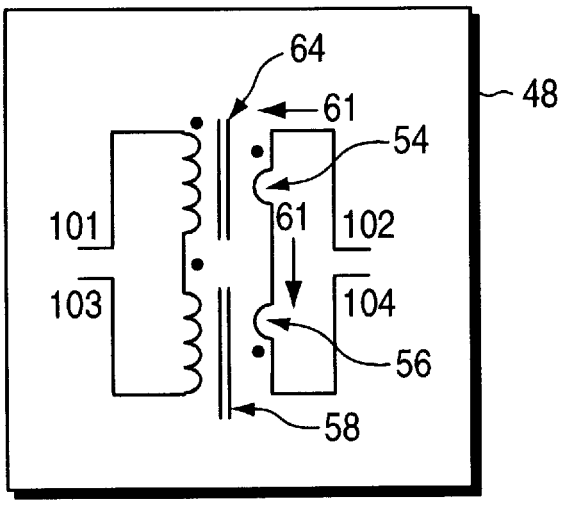
FIG. 7 shows a schematic diagram of a variable inductor for practicing the present invention.
Figure 8:
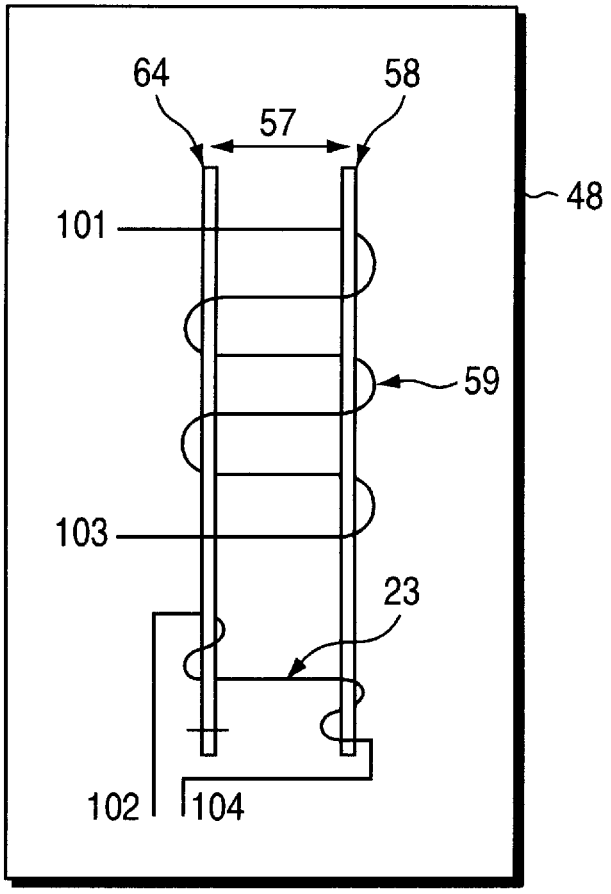
FIG. 8 is a pictorial illustration of FIG. 7.

FIG. 7 is a schematic diagram of a saturable reactor 48 for practicing the present invention, while FIG. 8 is a pictorial illustration of the reactor 48. By modifying the wiring technique used in prior art saturable reactors and using cores with matched physical and magnetic properties, the saturable reactor of the present invention effectively becomes a variable inductor for circuit analysis purposes. The preferred embodiment of the present invention uses a plurality of toroidal cores 58 and 64 because of their physical symmetry and their closed magnetic path. One skilled in the art will appreciate that it is also possible to use other geometries of magnetic cores as well. The RF signal path 61 of saturable reactor 48 comprises a circuit node 102, a circuit node 104, a coil 54, and a coil 56. The preferred embodiment of the present invention comprises a single turn coil for coil 54 and coil 56. Combining coils 54 and coil 56 produces a RF winding 23 for saturable reactor 48 of FIG. 8. The control circuit of reactor 48 comprises a terminal 101 and a terminal 103 with a coil 62 and a coil 60. Combining coil 60 and coil 62 produces a control winding 59 of FIG. 8.

The RF winding 23 and control winding 59 are configured to ensure that the induced EMF from the transformer action of one magnetic core is summed with an equal and opposite EMF from the other magnetic core before each turn of a control winding coil is completed. To put it another way, each coil turn of control winding 59 passes through the adjacent magnetic core before it again passes through the first magnetic core so the sum of the induced voltage around each turn is zero and, therefore, the RF potential at each point on a given coil turn is the same as at the corresponding point on the coil turns on either side of it. For this to happen, the RF winding 23 (combined coils 54 and 56), not the control winding 59 (combined coils 60 and 62), is wired in a bucking or opposing configuration as illustrated in FIG. 7.

The RF winding 23 is wound in a "figure 8" with the winding crossing in the gap 57 between magnetic core 58 and magnetic core 64 . For transformer purposes, this novel wiring of the RF winding 23 and the control winding 59 results in a bucking or opposing configuration. The reactor frequency limitations are now independent of the winding capacitances and rest solely on the losses attributable to the imaginary component of the permeability of the magnetic core, which increases with frequency. This novel wiring technique decouples the RF winding and the control winding by nearly 60 dB. Since the RF winding 23 does not induce any external ac currents in the circuit containing the control winding, an RF filter in the DC or control circuit is unnecessary. Although the preferred embodiment discloses a single turn coil for coil 54 and a single turn coil for coil 56, other embodiments of the present invention use multiple turn coils for coil 54 and multiple turn coils for coil 56 with the plurality of turn to turn coils being coupled together in series.

Figure 9:
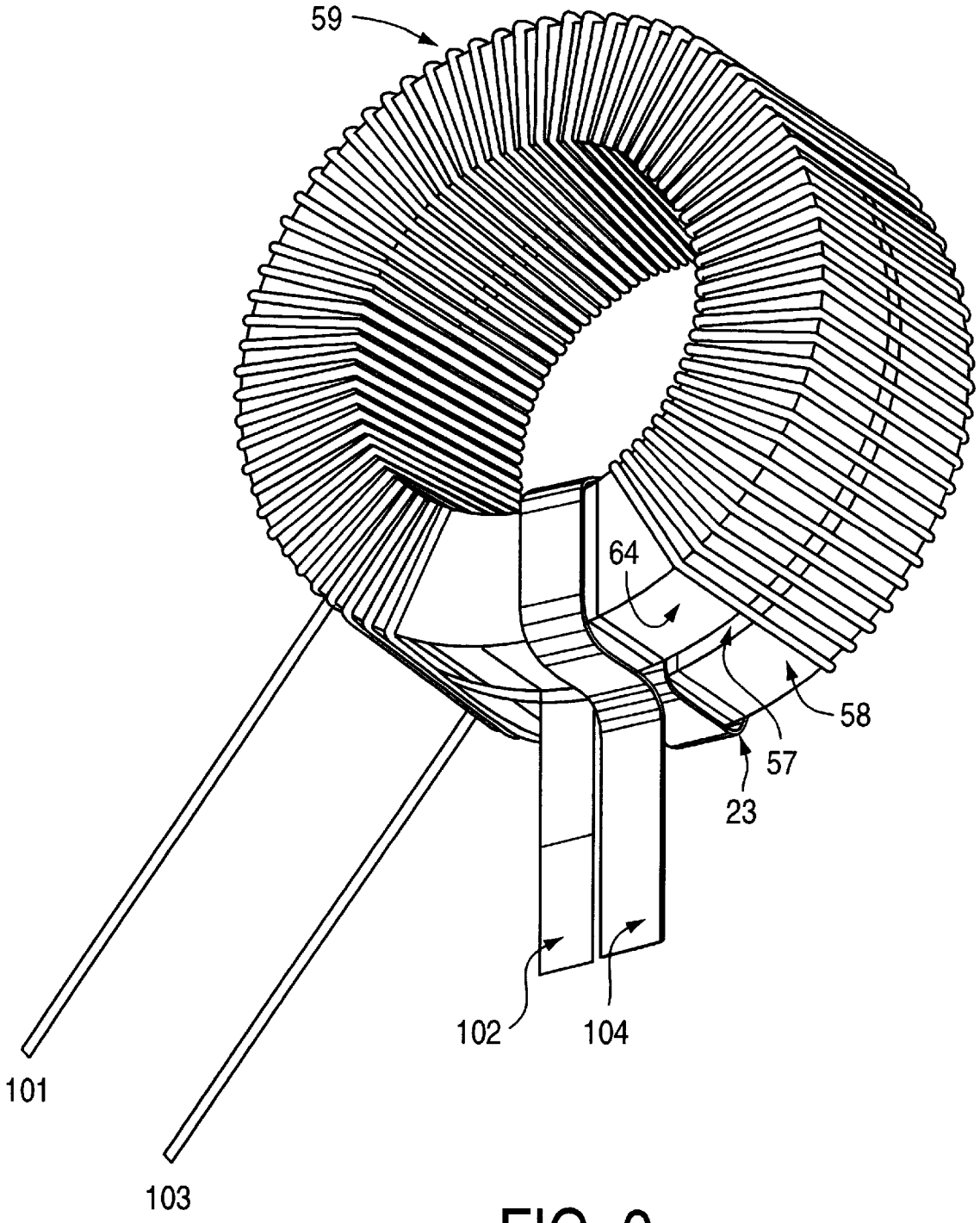
FIG. 9 is a pictorial illustration of an embodiment of the present invention as disclosed in FIG. 7.
Figure 10:
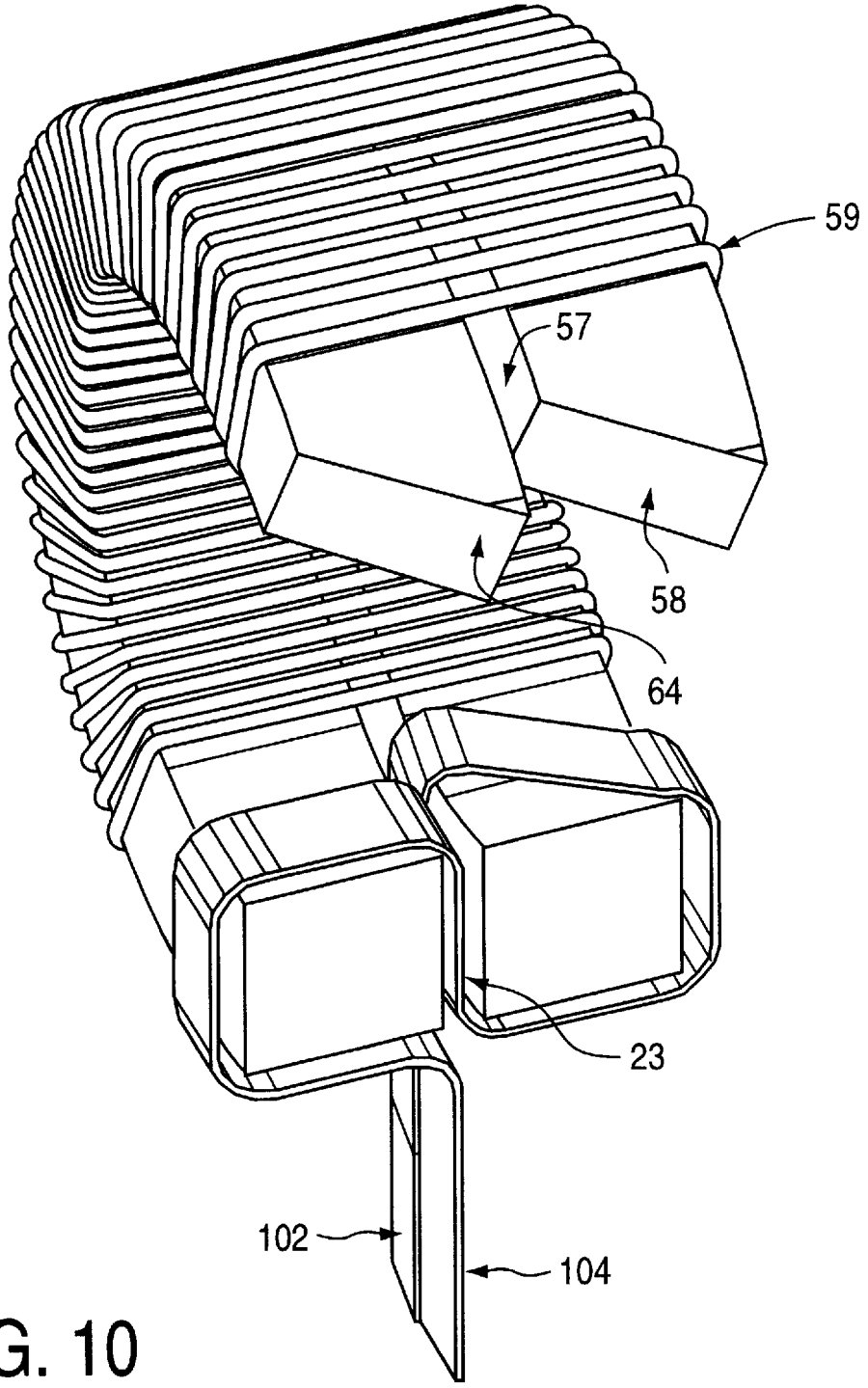
FIG. 10 is a side view illustration of FIG. 9.

FIG. 9 and FIG. 10 better illustrate the physical wiring of the RF winding 23 and the control winding 59 using toroidal magnetic cores. The two magnetic cores, 58 and 64, are placed side by side approximately ⅛" apart and the control winding 59 is wound through both magnetic cores as though it were only one thick magnetic core. One skilled in the art will appreciate that the distance between the two magnetic cores is not overly critical; however, a close proximity of the cores minimizes stray non-variable inductance between the cores. This embodiment used Amidon FT240-67 Amidon, Inc. of Santa Anna, Calif. toroidal magnetic cores constructed of Fair-Rite material #67 Fair-Rite Products Corp. of Wallkill, N.Y. The diameter of an individual magnetic core is approximately 2.4 inches without wiring and approximately 2.6 inches with wiring. An additional benefit of the present invention is it uses magnetic cores that are much smaller than used in the prior art. This embodiment uses a one-turn RF winding 23 and a 150-turn control winding 59. With the decoupling of the RF winding 23 from the control winding 59, this embodiment effectively becomes a variable inductor whose reactance varies from j50 Ω to j35 Ω as the control current advances from 1 to 12 amps, while the resistive component of the impedance varies from about 0.5 Ω to 0.375 Ω. Another benefit from the decoupling effect is that less current is necessary to transfer maximum power through the matching network. This allows us to use smaller diameter transmission lines than used in the prior art. With reduced current requirements, the present invention requires less effort to cool the system. For example, in the previously discussed embodiment, air cooling is sufficient to the cool the system.

Figure 11:
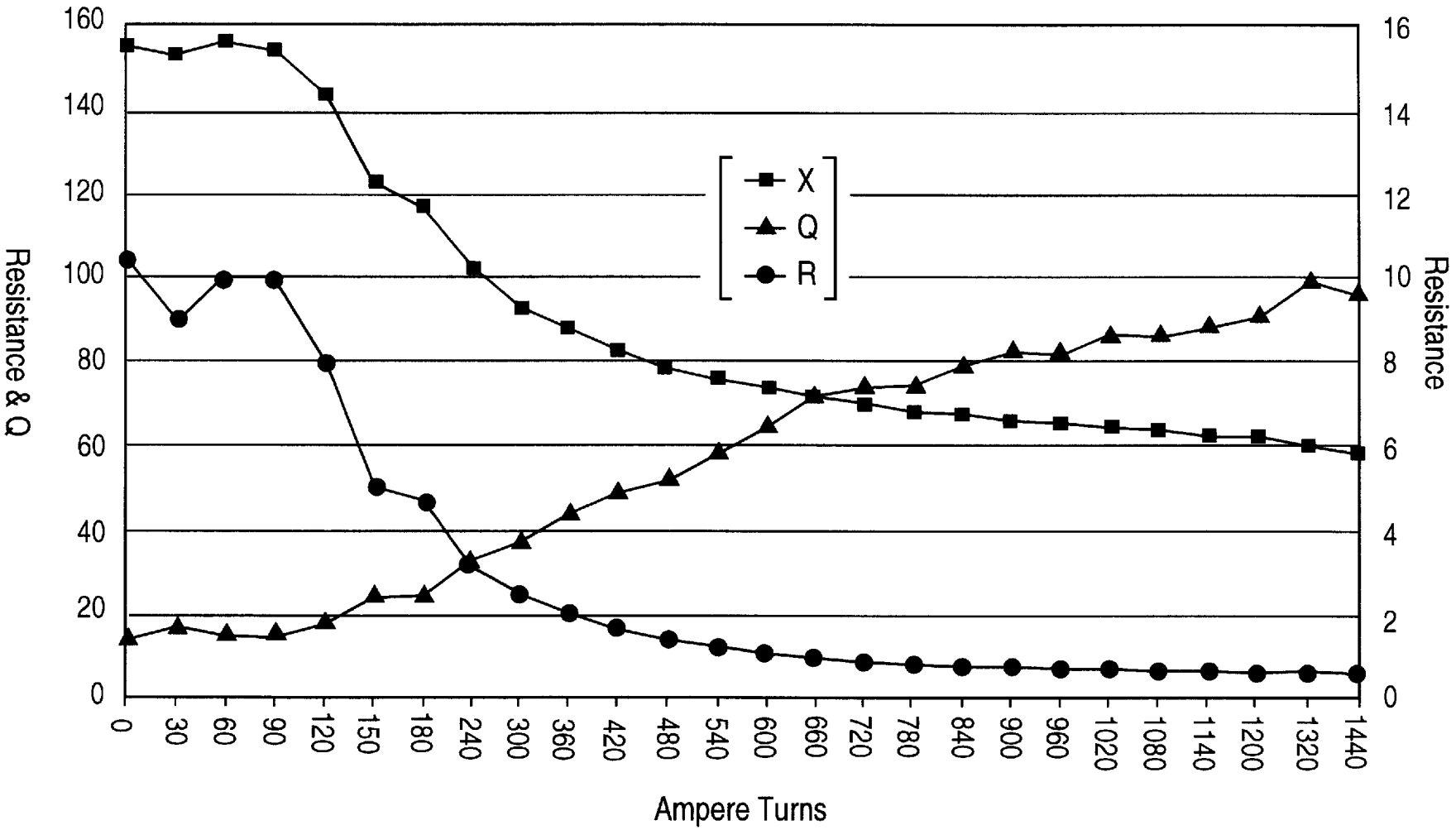
FIG. 11 illustrates the performance of the embodiment of FIG. 9 for ampere turns versus the resistance, capacitance, and reactance.

FIG. 11 illustrates the performance for the previous embodiment for ampere turns versus the resistance, capacitance, and reactance. This performance is achieved after the magnetic cores were taken to heavy saturation one time (a momentary DC control current of 30 amps) to place the magnetic cores on the hysteresis loop. If this heavy saturation step is omitted, the inductance will actually increase rather than decrease with the application of control current to the control winding.

Referring back to FIG. 9 and FIG. 10, Kapton and fiberglass tape were used to insulate and protect the RF winding and the control windings. Additionally, corona dope is useful in reinforcing the enamel coating on the control winding layers. These steps were done to prevent scrapes of the insulation during wiring of the RF and control windings from developing into shorted turns.

Figure 12:
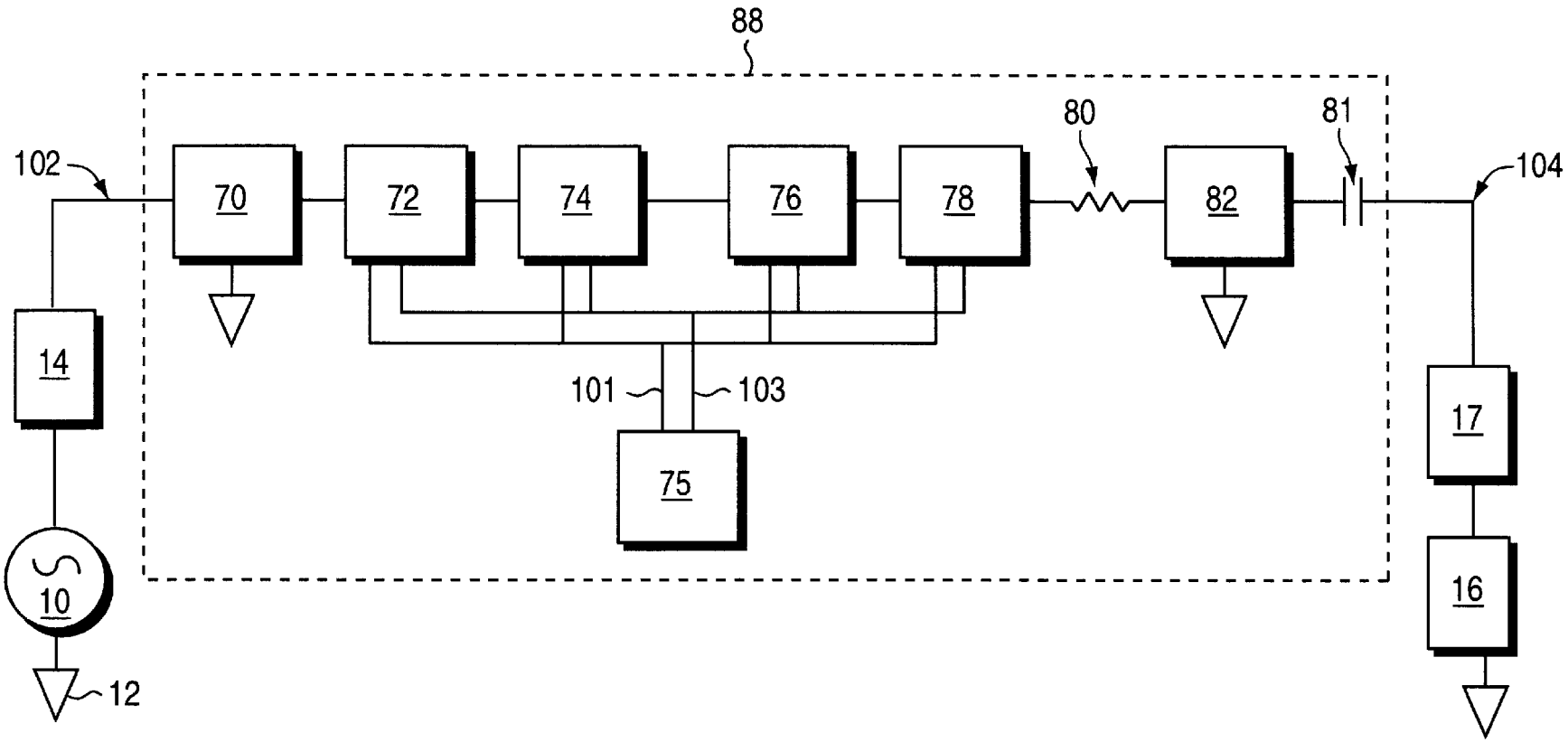
FIG. 12 shows a block diagram of an embodiment of the present invention for a matching network for matching the impedances of a generator and a load.
Figure 13:
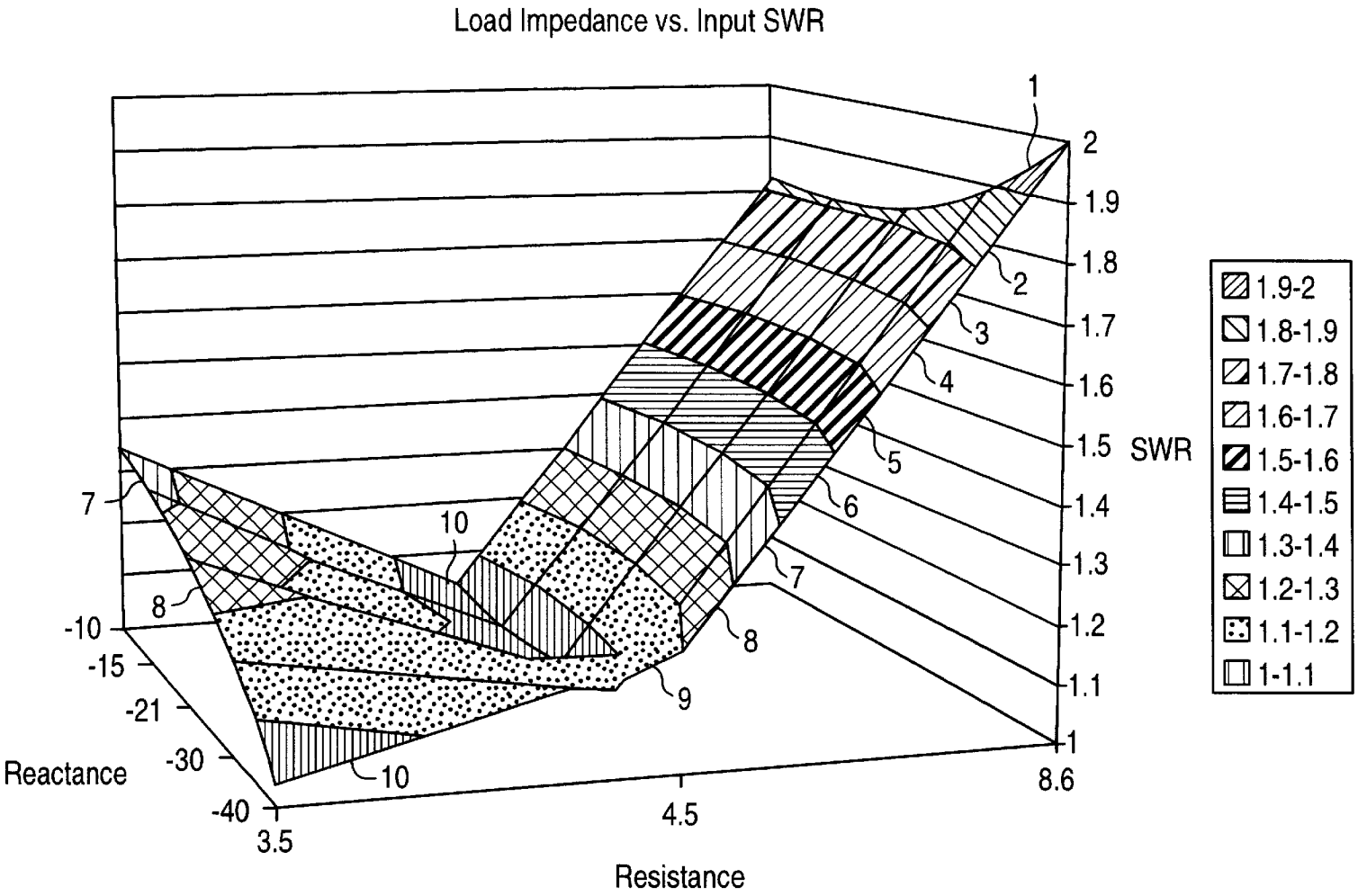
FIG. 13 illustrates the performance of an embodiment of the present invention for Load Impedance versus Input SWR.

FIG. 12 discloses another embodiment for practicing the present invention that includes a matching network 88 comprising one or more transformers, 70 and 82, and one or more saturable reactors, 72, 74, 76, and 78 comprising the novel wiring of the RF and control windings as previously discussed that effectively turn the saturable reactors into variable inductors for circuit analysis purposes. In this embodiment, delivered power from a generator 16 is controlled by adjusting the generator to compensate for losses occurring during the transmission of power to a load 17. If the delivered power is controlled, a conjugate match in the matching network between an output impedance 14 of generator 10 and an input impedance 16 of load 17 would not be necessary. However, operation within a specified Standing Wave Ratio (SWR) would be acceptable as is common with today's VHF and wideband HF communications transmission equipment. FIG. 13 illustrates the load impedance of the matching network of the present invention versus input SWR for transmitting power to the load.

Available data indicated that the resistive component of the load 17 varied over only a fairly narrow range, while the reactance of load 17 varied over a substantially larger range. This implies that if one could tune out the load reactance, the desired performance could be achieved by using fixed transformers to match the resistive component of the load to the generator source resistance. Such an approach offers several advantages. The matching network can tune with only one variable element, which tremendously simplifies a tuning algorithm making it faster and inherently more robust. Since the load is capacitive, the reactance can be canceled by an inductor, which permits the use of the previously disclosed saturable reactor as the tuning element. The tuner therefore can be electronically tuned, which enhances speed, and all moving parts are eliminated thereby enhancing reliability. Copper losses and ferrite core losses, denoted as resistor 80, in the matching network are diminished because the matching network operates in series resonance and large circulating currents, normally associated with tank circuits and the parasitic interwinding capacitance, are eliminated.

Referring again to FIG. 12, this embodiment uses a 3:1 impedance transformer 82 to lower the RF current entering into saturable reactors 72, 74, 76, and 78. With an air cooling of 100 cfm, matching network 88 will handle 1000 watts steady state power. A 4:1 impedance transformer 70 raises the impedance to 50 Ω to match the input impedance 14 of generator 10. A common 50 V supply provides power to the RF generator 10 and to a control circuit 75 that supplies the control current to the control windings in the saturable reactors. The combined control winding resistance is approximately 2 Ω. Power dissipated in the control winding can reach 300 watts, which is more than the RF losses at 1000 watts operating power. If linear regulation of the control current were employed, an additional 300 W of heat would be generated. Control circuit 75 comprises a pulse width modulated switching regulator circuit used to provide the control current for the control windings in the saturable reactors to minimize the power dissipation associated with the tuning current. Control circuit 75 couples to the reactors 72, 74, 76, and 78 through the terminals 101 and 103.

Figure 14:
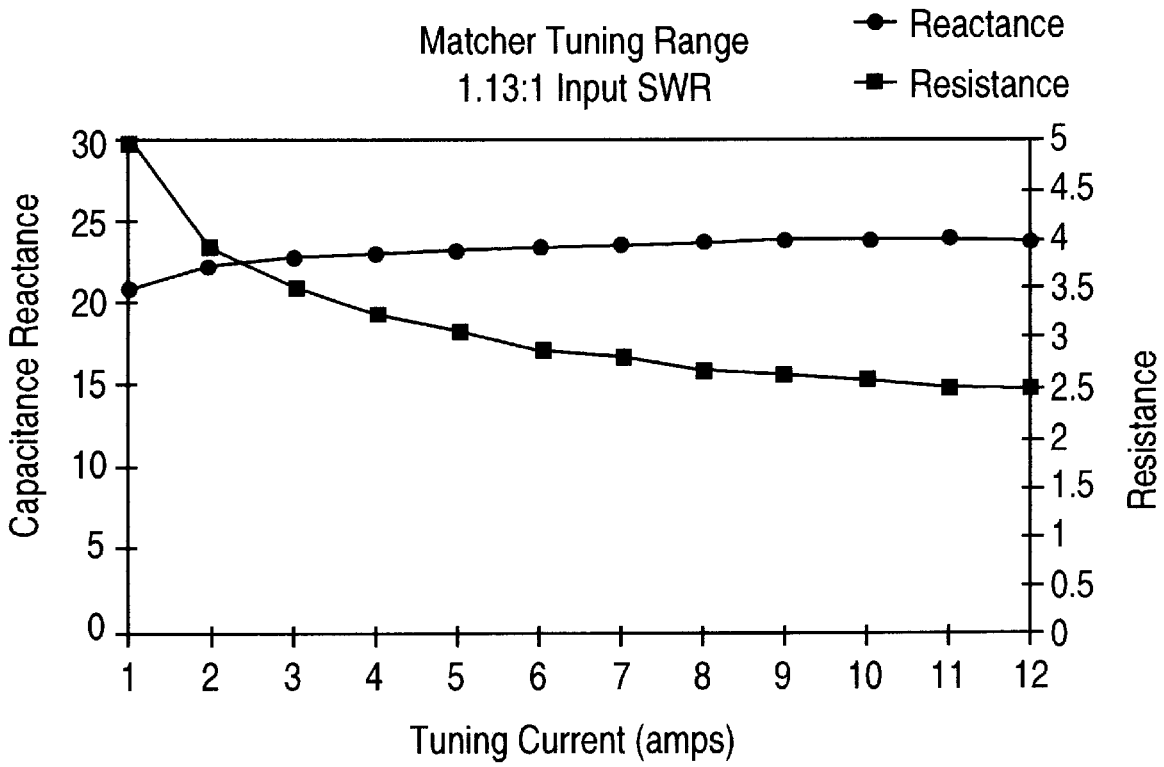
FIG. 14 illustrates the performance of an embodiment of the present invention for control current versus tuning range.

Since the hysteresis loop of the magnetic cores is nonlinear, the control current to reactor inductance transfer function is also non-linear. After hard saturation, the ferrite magnetic cores have higher losses below 1 amp of control current, so to preclude thermal runaway, the minimum control current is set at approximately 1 amp regardless of the demand signal coming from the controller. This resulted in the final tuning range of matching network 88 being narrowed to between −j13 Ω and −j30 Ω capacitive reactance. FIG. 14 illustrates the performance of the embodiment of FIG. 13 for the control current versus the tuning range. A fixed capacitor 81 can be used to move this 17 Ω reactive tuning window over a fairly wide range of reactances. In operation, the tuner's response time to a 10 Ω step change in load reactance is in the 5–10 ms range.

The present invention discloses a saturable reactor and a method for decoupling the interwinding capacitance from the frequency limitations of the reactor so that the equivalent electrical circuit of the saturable reactor comprises a variable inductor. In other words, the present invention provides an electronically variable inductor whose RF impedance is independent of the control winding circuit over all frequencies for which the magnetic cores remain matched in their magnetic properties. Additionally, the present invention discloses a matching network and method for matching the impedances of a RF generator to a load. The closed magnetic path of the magnetic cores requires less control current and therefore lower heat than for the other prior art designs with equivalent core or flux density. Further, the present invention allows use of small transmission lines and smaller magnetic cores than previously used. Additionally, RF filtering of the secondary winding is unnecessary in the present invention. And finally, the frequency response of the saturable reactor of the present invention is increased by a magnitude greater than previously seen.

I claim:

1. A variable inductor, comprising:

a plurality of magnetic cores with matching magnetic permeability and saturation flux density characteristics where each core has a physical symmetry and a closed magnetic path;

a control winding, said control winding is wired in an aiding configuration around said plurality of magnetic cores; and a RF winding, said RF winding is wired in an opposing configuration using a figure eight configuration around and through said plurality of magnetic cores, said RF winding produces a bootstrapping of interwinding capacitance for said control winding, and said RF winding causes the sum of the induced voltage around each individual turn of said control winding to be zero and the RF potential at each point on a given turn of either of said windings and induced by the other said winding to be the same as at the corresponding point on said windings on either side of the point.

2. The variable inductor of claim 1 wherein said plurality of magnetic cores further comprise toroidal cores.

3. The variable inductor of claim 1 wherein the wiring of said RF winding and said control winding decouples the winding capacitance from the frequency limitations of the reactor.

4. A method of manufacturing a variable inductor, comprising the following steps:

providing a plurality of magnetic cores with matching magnetic permeability and saturation flux density characteristics where each has a physical symmetry and a closed magnetic path;

wiring a control winding in an aiding configuration around said plurality of magnetic cores; and wiring a RF winding in an opposing configuration using a figure eight configuration around and through said plurality of magnetic cores, said RF winding produces a bootstrapping of interwinding capacitance for said control winding and said RF winding causes the sum of the induced voltage around each individual turn of said control winding to be zero and the RF potential at each point on a given turn of either of said windings and induced by the other said winding to be the same as at the corresponding point on said windings on either side of the point.

5. The manufacturing method of claim 4 wherein said plurality of magnetic cores further comprise toroidal cores.

6. The saturable reactor of claim 4 wherein the wiring of said RF winding and said control winding decouples thte winding capacitance from the frequency limitations of the reactor.

7. A process for varying a reactance, comprising the following steps:

providing a DC current to a control winding, said control winding is wired in an aiding configuration around a plurality of magnetic cores with matching magnetic permeability and saturation flux density characteristics where each core has a physical symmetry and a closed magnetic path; and providing an AC signal to a RF winding, said RF winding is wired in an opposing configuration using a figure eight configuration around and through said plurality of magnetic cores, said RF winding, produces a bootstrapping of interwinding capacitance for said control winding, and said RF winding causes the sum of the induced voltage around each individual turn of said control winding to be zero and the RF potential at each point on a given turn of either of said windings and induced by the other said winding to be the same as at the corresponding point on said windings on either side of the point.

8. The process of claim 7 wherein said plurality of cores further comprise toroidal cores.

9. The process of claim 7 wherein the wiring of said RF winding and said control winding decouples the winding capacitance from the frequency limitations of the reactor.

10. An apparatus for impedance matching, comprising:

an impedance transformer for matching a resistance; and a saturable reactor for matching a reactive impedance coupled to said impedance transformer, said saturable reactor further comprises:

a plurality of magnetic cores where each core has a physical symmetry and a closed magnetic path;

a control winding, said control winding is wired in an aiding configuration around said plurality of magnetic cores; and a RF winding, said RF winding is wired in an opposing configuration through said plurality of magnetic cores.

11. The apparatus of claim 10 wherein said plurality of magnetic cores further comprise cores with matching magnetic permeability and saturation flux density characteristics.

12. The apparatus of claim 10 wherein said plurality of magnetic cores further comprise toroidal cores.

13. The apparatus of claim 10 wherein the wiring of said RF winding further comprises a figure eight configuration around and between said plurality of magnetic cores.

14. The apparatus of claim 10 wherein the wiring of said RF winding further comprises a turn to turn bootstrapping of said control winding.

15. The apparatus of claim 10 wherein the wiring of said RF winding and said control winding decouples the winding capacitance from the frequency limitations of the reactor.

16. A process for impedance matching, comprising the following steps:

providing an AC signal to a matching transformer for matching a resistance, said matching transformer couples to a saturable reactor;

providing a DC current to a control winding of said saturable reactor, said control winding is wired in an aiding configuration around a plurality of magnetic cores in said saturable reactor where each core has a physical symmetry and a closed magnetic path, said DC current varies a reactive impedance of said saturable reactor; and providing said AC signal to a RF winding of said saturable reactor for matching said reactive impedance, said RF winding is wired in an opposing configuration through said plurality of magnetic cores of said saturable reactor.

17. The process of claim 16 wherein said plurality of magnetic cores further comprise cores with matching magnetic permeability and saturation flux density characteristics.

18. The process of claim 16 wherein said plurality of magnetic cores further comprise toroidal cores.

19. The process of claim 16 wherein the wiring of said RF winding further comprises a figure eight configuration around and between said plurality of magnetic cores.

20. The process of claim 16 wherein the wiring of said RF winding further comprises a turn to turn bootstrapping of said control winding.

21. The process of claim 16 wherein the wiring of said RF winding and said control winding decouples the winding capacitance from the frequency limitations of the reactor.

* * * * *